United States Patent [19]

Badone et al.

[11] 4,098,929

[45] Jul. 4, 1978

[54] METHOD FOR IMPROVED PARTING FROM HOT SURFACES

[75] Inventors: Louis Badone, Willowdale; Alexander March, Mississauga, both of Canada

[73] Assignee: Chrysler Corporation, Highland Park, Mich.

[21] Appl. No.: 415,860

[22] Filed: Nov. 12, 1973

[51] Int. Cl.[2] ..... B22D 41/02

[52] U.S. Cl. ..... 427/236; 427/239; 427/318; 427/135; 164/47; 164/121; 106/38.22

[58] Field of Search ..... 117/104 R, 114 C, 169 R, 117/5.3, 71 M; 427/422, 318, 135, 133, 134; 164/47, 72, 73, 121; 106/38.22, 38.24, 38.28, 56, 307

[56] References Cited

U.S. PATENT DOCUMENTS

| | | | |
|---|---|---|---|
| 1,693,923 | 12/1928 | Hess | 427/135 X |
| 1,882,882 | 10/1932 | Poe | 117/5.3 |
| 2,245,651 | 6/1941 | Craig et al. | 106/38.22 X |
| 2,246,463 | 6/1941 | Garratt | 427/318 X |
| 2,289,709 | 7/1942 | Kelly | 106/38.24 X |
| 2,618,032 | 11/1952 | Traenkner | 427/133 |
| 2,770,859 | 11/1956 | Henry | 106/38.25 X |
| 2,784,108 | 3/1957 | Cupperi | 117/5.3 |
| 2,923,041 | 2/1960 | Ryznar | 427/135 X |
| 2,932,576 | 4/1960 | Vierk et al. | 427/318 |
| 2,956,890 | 10/1960 | Casteras | 117/5.3 |
| 3,193,888 | 7/1965 | Rochester | 117/5.3 |
| 3,340,082 | 9/1967 | Meyer et al. | 117/5.3 |
| 3,495,962 | 2/1970 | Norton | 106/38.24 X |
| 3,637,412 | 1/1972 | Felice et al. | 106/38.28 |
| 3,708,869 | 1/1973 | Anderson | 117/5.3 |
| 3,929,499 | 12/1975 | Thomas | 106/38.24 X |

FOREIGN PATENT DOCUMENTS

| | | | |
|---|---|---|---|
| 551,920 | 1/1958 | Canada | 106/38.24 |
| 1,111,690 | 11/1955 | France. | |
| 1,025,027 | 1/1953 | France. | |
| 1,154,303 | 6/1969 | United Kingdom. | |
| 1,147,512 | 4/1969 | United Kingdom. | |
| 842,027 | 7/1960 | United Kingdom. | |
| 453,096 | 9/1936 | United Kingdom. | |

*Primary Examiner*—Ralph S. Kendall
*Attorney, Agent, or Firm*—Baldwin & Newtson

[57] ABSTRACT

A method comprising the application of colloidally suspended graphite emulsified in water as a parting agent to hot surfaces and in particular to ladles to facilitate pouring therefrom and the formation of sound castings.

24 Claims, No Drawings

METHOD FOR IMPROVED PARTING FROM HOT SURFACES

BACKGROUND

In many industries, from time to time, it is necessary to apply coatings to hot surfaces. The coatings function in the nature of a parting agent between the surface to which they have been applied and some other material which otherwise would come in contact with that surface and adversely interact with it.

Specifically, for example, in the development of piston casting equipment of the type disclosed in the Louis Badone et al application Ser. No. 188,056 now U.S. Pat. No. 3,977,460 and in the R. J. Fulton et al application Ser. No. 293,712 now U.S. Pat. No. 3,979,033, there is the problem of preventing molten aluminum from sticking to the inside of a ladle used to pour the aluminum in molding the pistons. There are several undesirable aspects to the problem.

Firstly, if aluminum in the form of aluminum and aluminum oxide skins remain on the inside of the ladle when additional molten aluminum is added to the ladle, this material tends to be included in the pour as the molten aluminum is poured and causes undesirable defects in the pistons produced.

Secondly, with the stream of metal which fills the ladle always hitting the same spot due to the automatic ladle filling arrangement used with the above referenced equipment, erosion of the inside of the ladle takes place at that spot so that mechanical adhesion of aluminum and aluminum oxide skins to the ladle results.

Thirdly, any of the deposits which adhere to the inside of the ladle can deflect the metal stream so that in extreme cases, metal does not enter the mold but pours over the molding equipment.

It is accordingly desirable to have a ladle in which the oxide skin, while it is still hot and flexible, can be removed by turning the ladle over so that the skin drops out of the ladle before the ladle is refilled with molten aluminum. Various ladle materials have been tried, but none have been found which have the desired non-sticking characteristics. The well established practice of coating the ladle with various state-of-the art parting agents has also been tried. For example, the hand application of mixtures of grease and graphite have been found to generally give the desired behavior but have the disadvantageous that one necessarily relies upon many people to carry out the coatings and the method of application has thus been variable. Additionally, the grease in contact with the hot ladle surface bursts into flame and produces large amounts of smoke and unsatisfactory working conditions. Added to this are odors and excessive heat exposure to the operator.

It is therefore obvious that some other kind of coating is required, preferably an automatically applied coating, both from a consistency of application and an environmental control point of view.

For a time, the use of colloidal graphite dispersions, which have been used for a long time in metal working processes as parting agents, looked attractive. Colloidal graphite suspended in a variety of carrier liquids is commercially available and the idea was to find a colloidal graphite dispersion which could be sprayed into a ladle after each pour therefrom, before the refilling of the ladle, so that the aluminum and aluminum oxide skin would drop out of the ladle cleanly prior to its being refilled.

Spraying is preferred for application because it is fast and more uniform. The time available for coating in an automatic set-up of the tupe referred to above is very short, amounting to only two or three seconds between the return of the ladle to the filling position after pouring and the ladle being filled.

Initially colloidal graphite suspended in three materials respectively; namely, water, isopropyl alcohol and mineral spirits (kerosine type material) was tested.

Graphite in water was unsatisfactory since a coating could not be established at the temperature that the ladle was operating. The spray appeared to go into the ladle and ricochet out again with very little material being deposited on the ladle surface. The little material deposited did not give any marked parting action since very little graphite was actually deposited.

Graphite in isopropyl alcohol gave very little graphite material adhering to the ladle surface but gave somewhat better separation of the aluminum and aluminum oxide skin residue from the ladle surface. However, the alcohol showed a great tendency to ignite during spraying and also dried in the spray heads and host lines under the hot conditions existing in the foundry area and this gave a large amount of unreliability. Generally, the use of large amounts of alcohol as a carrier for the graphite is considered to be unsatisfactory and dangerous in a foundry.

The third material tried was colloidal graphite dispersed in mineral spirits or kerosine. A commercially available variety was obtained from Acheson Colloids of Brantford, Ontario, Canada, identified by them as Acheson Dispersion No. 2404. When diluted further with kerosine and sprayed into a ladle, much more graphite was deposited, although a substantial amount of material still bounced back out of the hot ladle to cover surrounding areas. The separation of the aluminum and aluminum oxide skin from the ladles was much better with this material and in general, ignition of the kerosine type solvent did not occur. Although, from time to time when the spraying conditions were unsatisfactory due to spray heads going out of adjustment, large sheets of flame would be produced during the coating process. In addition, the vapor from the mineral spirit carrier made for unsatisfactory working conditions in the area. This type of material was used in actual production in a foundry for a short period, but the smell and irritation to eyes caused by the vapor caused the abandonment of this material as a practical coating.

SUMMARY OF THE INVENTION

At this point, the idea of emulsifying colloidal graphite, or an equivalent parting agent particle, suspended in relatively small amounts of mineral spirits, for example, the Acheson 2404, in relatively large amounts of water as the major carrier was conceived. The concept was that the relatively small amount of kerosine suspension media for the colloidal parting agent particle emulsified in the relatively large amount of water produces less objectionable vapor but carries adequate amounts of parting agent particles to the ladle. The water would carry droplets of colloidal particles suspended in mineral spirits to the hot ladle surface where they would form a coating and the amount of mineral spirits evaporated would be minimal. Relatively small amounts of mineral spirits compared to the amount of water would be involved.

First samples showed a great deal of promise. Graphite coatings adhered very readily with much less over-spray. Smell and irritation were completely absent from the working area and fire hazards were eliminated.

PREFERRED EMBODIMENTS

Based on tests using ladles for pouring molten aluminum it was determined that about 10% by weight graphite colloidally suspended in a mineral spirits type of media, as hereinafter defined, which is then diluted with 5 parts water provides an optimum parting agent composition. Variations from these relative amounts function satisfactorily to varying degrees. In general, however, the amount of mineral spirits emulsified in the water carrier would be small, relatively speaking. The preferred mixture is now commercially available from Surbond Lubricants, Ltd. of Milton, Ontario, Canada as its "2404 Ladle Coating."

The term "mineral spirits type media" is meant to include colloidal suspension media of the petroleum distillate type within the general boiling point range of about 150° to 400° F. The preferred suspension media for the colloidal particles is naptha, commonly referred to as painters' naptha or referred to as petroleum spirits having a boiling point range of about 200° to 300° F. or kerosine having a boiling point range of about 300° to 400° F, the latter being even more preferred.

The term "parting agent particle" is meant to include non-reactive colloidal size particles suitable as parting agents, e.g., finely divided clays, china, alumina, iron oxide, molybdenum disulfide, mica, chromium oxide, "Whiting" and other similar particles, graphite being preferred.

From experience with the coating of permanent molds with suspensions consisting of water and such colloidal size materials as china, colloidal mica and "Whiting", it has been found that the temperature of the surface to be coated is important if a satisfactory coating is to be obtained. The temperature of a mold needs to be about 400° - 450° F. when being coated with water suspension. If the temperature is too low, say in the 300° F. range, the spray will not dry very quickly and the suspension will run down the surface being sprayed giving areas where almost no coating remains. If the surface is too hot, say 500° - 550° F., then the droplets of suspension do not adhere to the surface but bounce off again because of the rapid formation of steam and thin, uneven coatings result.

The temperature of the surface to be coated by water suspensions in the permanent mold experience thus needs to be about 200° - 250° F. above the boiling point of the water dispersant for the coating. This knowledge is directly applicable to this invention.

The mineral spirits dispersant in the Acheson 2404 has an initial boiling point of 290° - 310° F. and a final boiling point of 370° - 380° F. Temperature measurements on ladles of the type referred to above show the surface temperature of these ladles at the time of coating to be in the region of 600° - 650° F. due to the heat supplied by the molten aluminum they contain. It thus appears that there is an interval of about 200°-250° F. between the final boiling point of the liquid that the colloidal graphite is colloidally dispersed in and the temperature of the hot surface to be coated.

The general principle underlying the present invention is as follows: In order to deposit a graphite or other parting agent particle coating on a hot surface, the particles should be colloidally suspended or dispersed in a liquid carrier which boils at a temperature of about 200°-250° F. below the temperature of the hot surface. However, problems arise with air pollution where such materials as oils, petroleum distillates and liquids other than water are used alone as the carrier. In the present concept the water carrier evaporates quickly and cleanly, leaving the relatively small amount of mineral spirits carrier with the particles to dry. A minimal environmental impact is the result.

The invention avoids the massive generation of objectionable and dangerous fumes by keeping the coating (in the preferred case colloidal graphite) in a concentrated colloidal suspension dispersion in a mineral spirit type media and then emulsifying this suspension in water so that the graphite-mineral spirits suspension is widely dispersed in the water as fine droplets. The preferred mechanism for producing the graphite coating on the ladle is one where the emulsion mixture is propelled as a fine spray toward the hot surface. The water portion of the spray evaporates rapidly on approach to the hot surface but the graphite-mineral spirits droplets with their higher boiling point continue on their path and impinge on the hot surface. Because of the higher final boiling point and long boiling point range of the mineral spirits type media in which the colloidal graphite is suspended, the droplets spread out on the hot surface and leave the fine colloidal graphite behind on the surface as a coating when the mineral spirits media has evaporated.

What is claimed is:

1. The method of applying graphite to a surface for assuring improved parting therefrom, comprising the steps of:

heating a surface adapted to receive the graphite, applying a graphite suspension to the heated surface, the suspension consisting essentially of colloidal graphite suspended in a mineral spirits type of media which is, in turn, emulsified in water, whereby a coating consisting essentially of the graphite particles is formed on the heated surface.

2. The method of claim 1 wherein the suspension is applied by spraying it.

3. The method of claim 1 wherein the mineral spirits media and water are present in about a 1:5 ratio.

4. The method of claim 1 wherein the graphite is present in the mineral spirits media in an amount of about 10% by weight.

5. The method of claim 1 wherein the mineral spirits is kerosine.

6. The method of claim 1 wherein the mineral spirits is kerosine, the graphite is present in an amount of about 10% by weight in colloidal suspension in the kerosine and the graphite-kerosine is emulsified in a water carrier, the kerosine and water being mixed in about a 1.5 ratio.

7. The method of improving the pouring of molten aluminum from a ladle comprising the steps of:

heating the ladle and applying, between fillings the ladle with molten aluminum, a graphite suspension to the ladle surface, the suspension consisting essentially of colloidal graphite suspended in a mineral spirits type of media which is in turn emulsified in water, whereby a coating consisting essentially of the graphite particles is formed on the heated surface.

8. The method of claim 7 wherein the suspension is applied by spraying it.

9. The method of claim 7 wherein the mineral spirits media and water are present in about a 1:5 ratio.

10. The method of claim 7 wherein the graphite is present in the mineral spirits media in an amount of about 10% by weight.

11. The method of claim 7 wherein the mineral spirits is kerosine.

12. The method of claim 7 wherein the mineral spirits is kerosine, the graphite is present in an amount of about 10% by weight in colloidal suspension in the kerosine and the kerosine is emulsified in a water carrier, the kerosine and water being mixed in about a 1:5 ratio.

13. The method of applying graphite particles to hot surfaces comprising:

colloidally suspending the graphite particles in a mineral spirits type of carrier media having a final boiling point of about 250° F. lower than the temperature of the hot surface, emulsifying the colloidal suspension thus formed in water, and applying the resultant emulsion mixture to the hot surface.

14. The method of claim 13 wherein the mineral spirits media is one having a boiling point in the range of from about 150° to about 400° F.

15. The method of claim 13 wherein the mineral spirits media is selected from the group consisting of kerosine, naptha and mixtures thereof.

16. The method of pouring molten aluminum into molds comprising the steps of:

heating a ladle, colloidally suspending the graphite particles in a mineral spirits type of carrier media having a final boiling point of about 250° F. lower than the temperature of the hot ladle surface, emulsifying the colloidal dispersion thus formed in water, and applying the emulsion mixture to the ladle between the times it is filled with molten aluminum whereby a coating of graphite is formed.

17. The method of claim 16 wherein the emulsion is sprayed on the ladle surface.

18. The method of claim 16 wherein the mineral spirits media is selected from the group consisting of kerosine, naptha amd mixtures thereof.

19. The method of applying parting agent particles to hot surfaces to form a parting coating thereon, comprising:

colloidally suspending the particles in a mineral spirits type of carrier media having a final boiling point of about 250° F. lower than the temperature of the hot surface, emulsifying the colloidal suspension thus formed in water, and applying the resultant emulsion mixture to the hot surface.

20. The method of pouring molten metal into molds comprising the steps of:

heating a ladle, colloidally suspending parting agent particles in a mineral spirits type of carrier media having a final boiling point of about 250° F. lower than the temperature of the hot ladle surface, emulsifying the colloidal dispersion thus formed in water, and applying the emulsion mixture to the ladle between the times it is filled with molten metal whereby a parting agent coating is formed.

21. The method of claim 20 wherein the emulsion is sprayed on the ladle surface.

22. The method of claim 20 wherein the mineral spirits media is selected from the group consisting of kerosine, naptha and mixtures thereof.

23. The method of claim 20 wherein the parting agent particles are colloidal graphite.

24. The method of claim 20 wherein the mineral spirits media is one having a boiling point in the range of from about 150° F. up to about 400° F.

* * * * *